United States Patent [19]

Ueng

[11] 4,185,826

[45] Jan. 29, 1980

[54] CIRCULAR BUTTERFLY

[76] Inventor: Ming-Shean Ueng, 740 W. End Ave., Apt. 135, New York, N.Y. 10025

[21] Appl. No.: 810,035

[22] Filed: Jun. 27, 1977

[51] Int. Cl.[2] ..... A63B 65/10

[52] U.S. Cl. ..... 273/106 B

[58] Field of Search ..... 273/106 B; 46/74 D

[56] References Cited

U.S. PATENT DOCUMENTS

| | | | |
|---|---|---|---|
| D. 241,565 | 9/1976 | Molenaar | 273/106 B X |
| 2,822,176 | 2/1958 | Robes | 273/106 B |
| 3,828,466 | 8/1974 | Geiger | 273/106 B X |
| 3,955,817 | 5/1976 | Davis | 273/106 B X |
| 4,065,873 | 1/1978 | Jones | 273/106 B X |

FOREIGN PATENT DOCUMENTS

| | | | |
|---|---|---|---|
| 2246469 | 3/1973 | Fed. Rep. of Germany | 273/106 B |
| 2306132 | 8/1974 | Fed. Rep. of Germany | 273/106 B |
| 379907 | 9/1907 | France | 273/106 B |

OTHER PUBLICATIONS

The Washington Post 4-9-1950, p. 2, of the Parade Section.

The Times Herald, 1-11-1954.

*Primary Examiner*—Paul E. Shapiro

[57] ABSTRACT

A circular butterfly is a kind of throwing implement, which comprises a circular saucer having a number of radial holes and grooves, and a round hole at the middle, a number of rotatable leaves, a rotatable adjusting disk and a circular plate fixed on the said adjusting disk.

11 Claims, 19 Drawing Figures

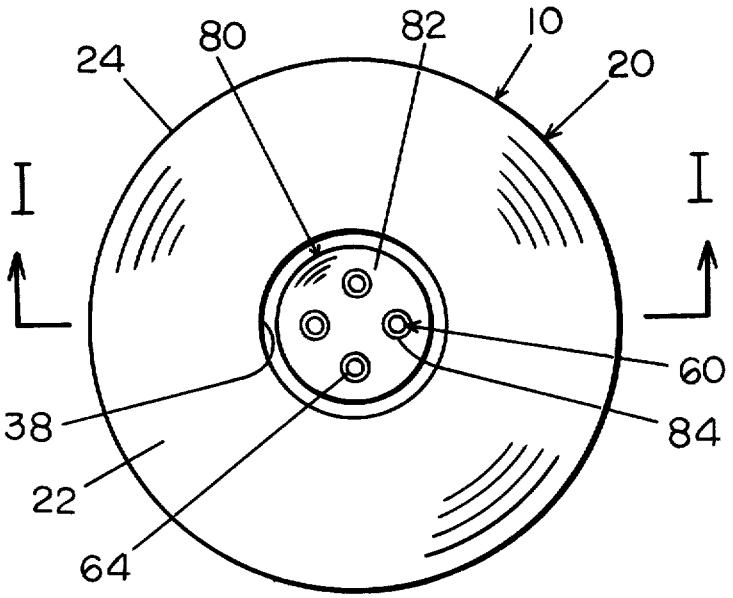
FIG. 1
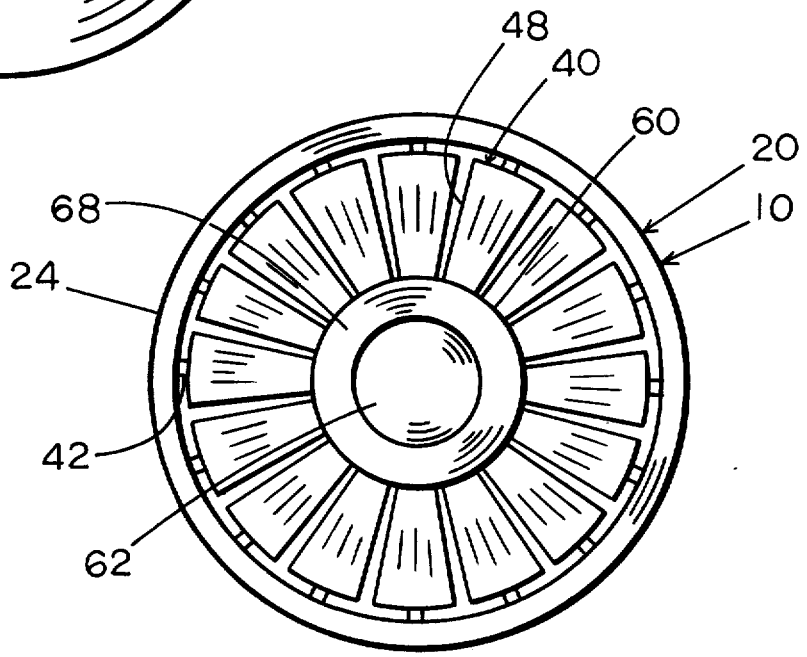
FIG. 2
FIG. 3
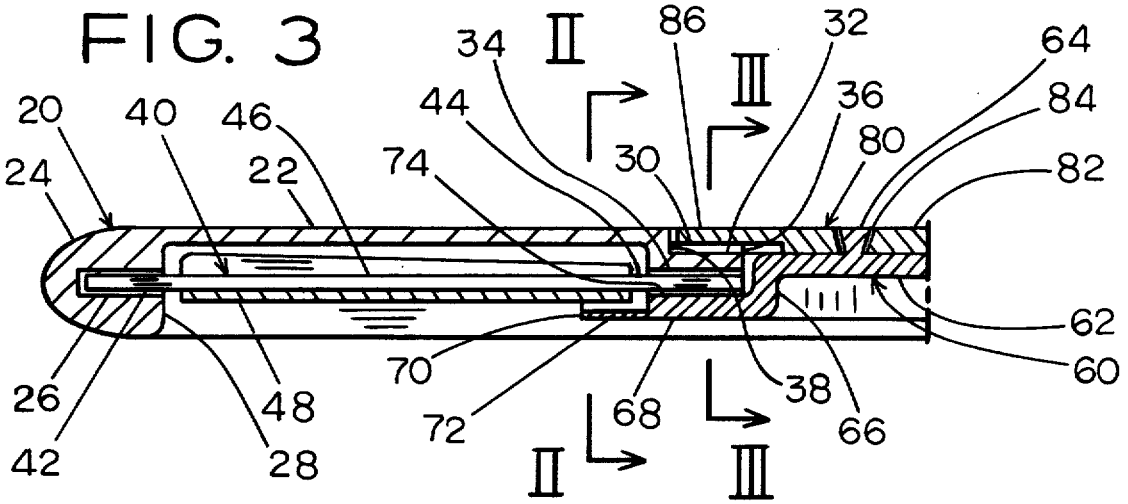

FIG. 4
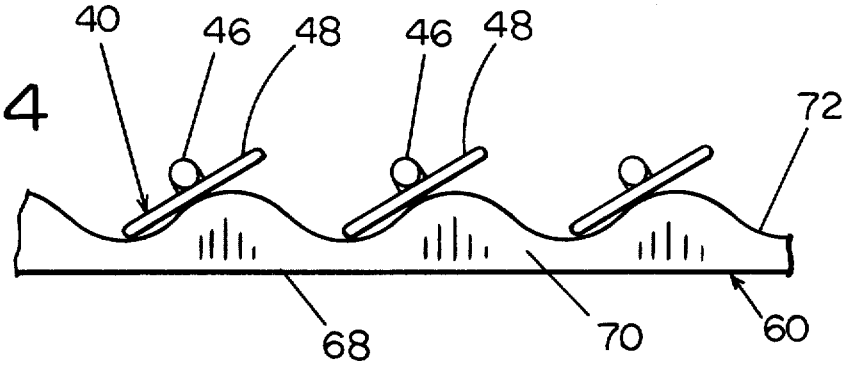
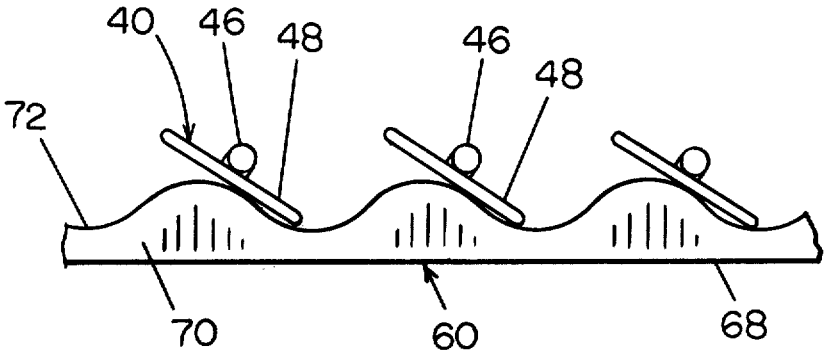
FIG. 5
FIG. 6
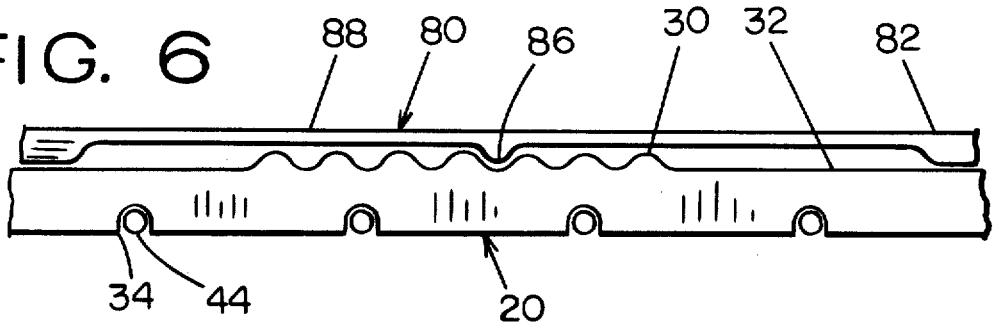
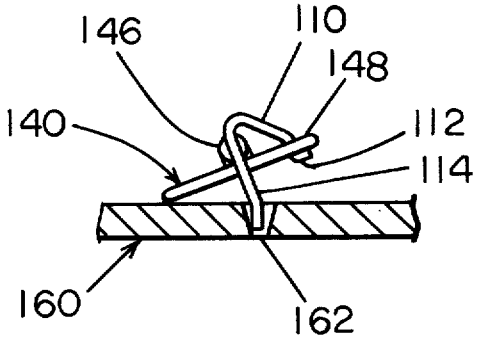
FIG. 7
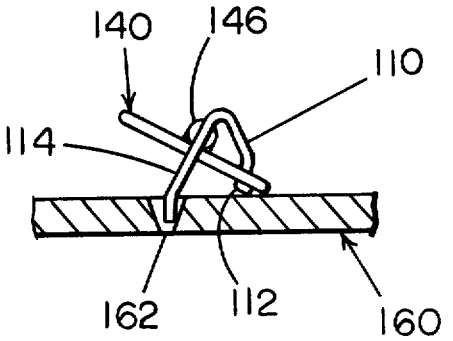
FIG. 8

FIG. 16
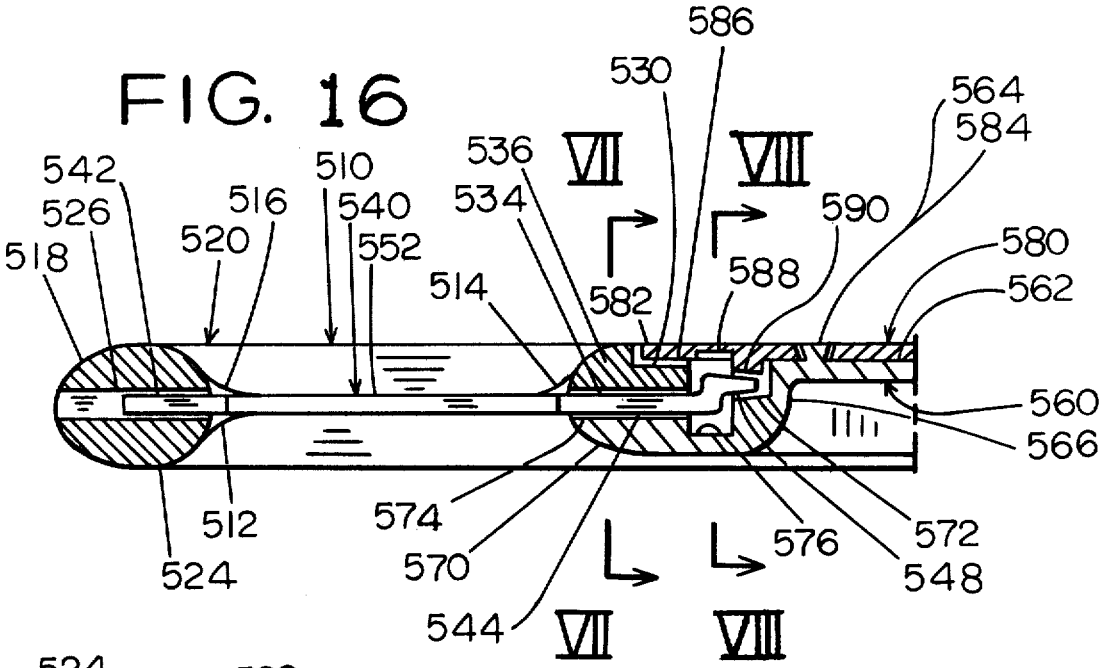
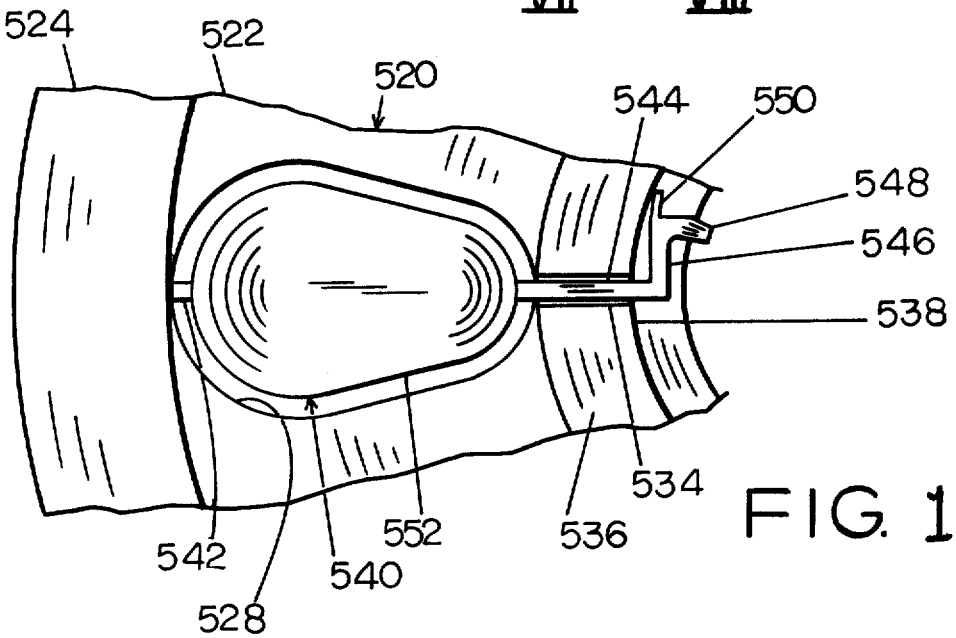
FIG. 17
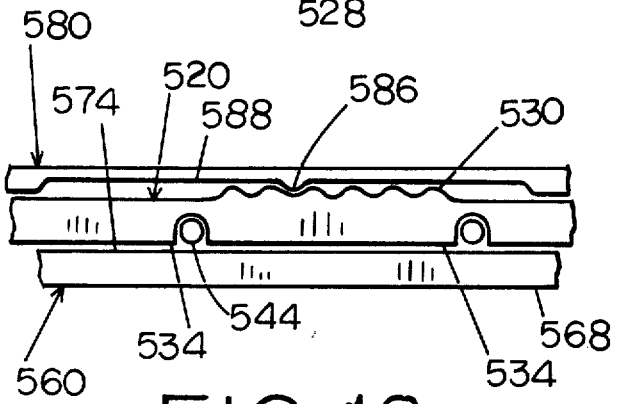
FIG. 18
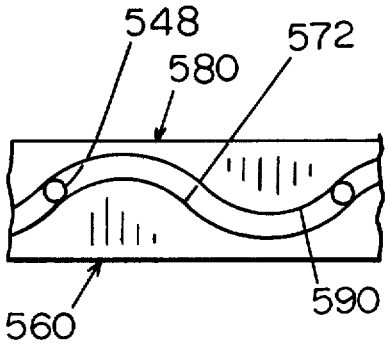
FIG. 19

CIRCULAR BUTTERFLY

BACKGROUND OF THE INVENTION

This invention relates to a throwing implement used in outdoor games. When an object is thrown into the air it follows a path of parabola. In the outdoor games, it is better to throw an object higher and farther. However, it is more useful to let the object to stay in the air for a longer time to allow someone to catch it before it reaches the ground.

The principal object of this invention of circular butterfly is to provide a throwing implement with a number of leaves which allow the flying implement to soar higher and to stay longer in the air.

A further object of this invention is to provide a throwing implement with a lower profile which enables the implement to be thrown farther away because of the smaller drag force.

A still further object of this invention is to provide a throwing implement with an adjusting device to alter the flying path, to change the flying height and distance to suit the size of a play yard and to add more fun accordingly.

DESCRIPTION OF THE DRAWING

The objects, characteristics and advantages of this invention will be more fully understood from the accompanying drawings, in which:

FIG. 1 is a top view of the first preferred embodiment,

FIG. 2 is a bottom view of FIG. 1,

FIG. 3 is a cross sectional view taken along line I—I in FIG. 1,

FIG. 4 is a cross sectional view taken along line II—II in FIG. 3,

FIG. 5 is a cross sectional view similar to FIG. 4,

FIG. 6 is a cross sectional view taken along line III—III in FIG. 3,

FIG. 7 is a view similar to FIG. 4, showing the second preferred embodiment having different adjusting device, FIG. 8 is a cross sectional view similar to FIG. 7, FIG. 16 is a cross sectional view of the fifth preferred embodiment, FIG. 17 is a portion of a bottom view of FIG. 16, showing mainly a leaf, FIG. 18 is a cross sectional view taken along line VII—VII in FIG. 16, showing the method to set the angular position of leaves, and FIG. 19 is a cross sectional view taken along line VIII—VIII in FIG. 16, showing the method to change the angular position of leaves.

DESCRIPTION OF THE INVENTION

Figure 9:
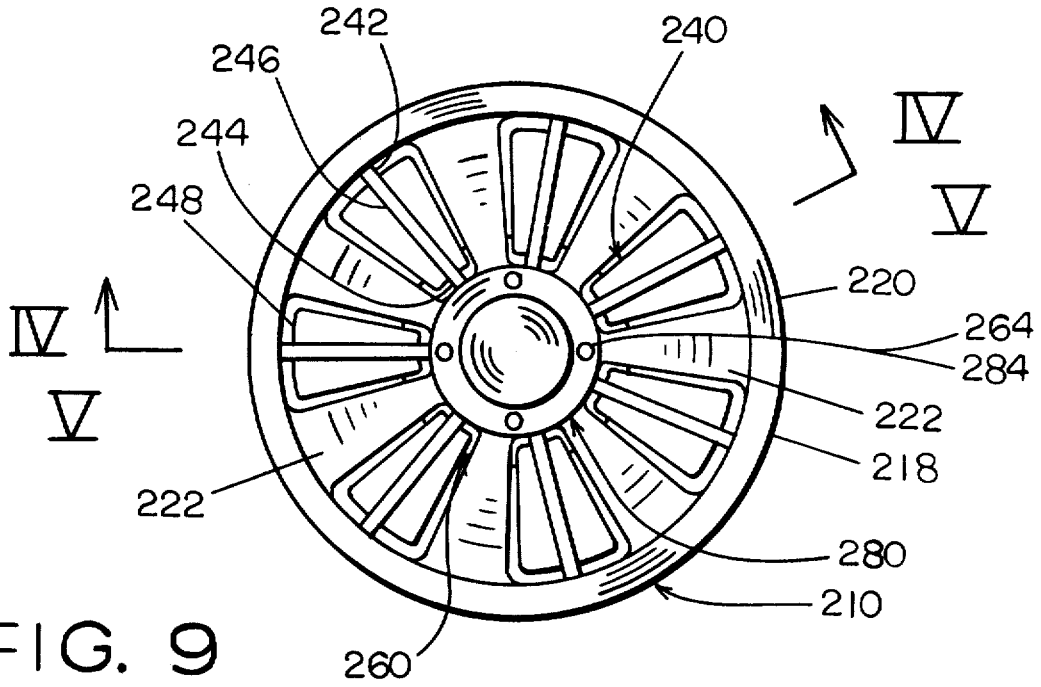
FIG. 9 is a top view of the third preferred embodiment.

Now, referring to FIG. 1 there is shown a top view of a circular butterfly 10 of this invention. A circular saucer 20 has a round surface 22 and a circular rim 24. At the center of round surface 22 there is a vertical circular rim 38 in which, a rotatable circular plate 80 is guided. On circular plate 80 there are a disk 82 and a number of tapered holes 84 to fit the same number of studs 64 which are on adjusting disk 60.

A bottom view of FIG. 1 is shown in FIG. 2. Again, a circular saucer 20 is shown which has a circular rim 24 on the circumference of circular butterfly 10. There are a number of leaves 40. Each leaf 40 has a leaf surface 48 with any preferred shape in cross section and an outboard end 42. Both sides of leaf 40 can be of parallel, radial or other kinds. A gap is provided between leaves 40 to allow them to rotate without interference. At the center there is an adjusting disk 60 having a center disk 62 and an outboard ring surface 68.

In FIG. 3 a clear picture can be seen, which is a half cross section taken along line I—I in FIG. 1. The circular saucer 20 has a round surface 22, a circular rim 24 with the shape of an air foil, a number of radial holes 26, a vertical circular rim 28, a partial corrugation 30 at the center area of lower ring surface 32, a number of radial grooves 34, a vertical circular rim 36 and another vertical circular rim 38 adjacent to the other edge of lower ring surface 32. The depth of radial hole 26 can be of a through hole so that it is easier to manufacture. The radial groove 34 is an U-shaped type with the lower side opened to facilitate the installation of leaf 40. The function of corrugation 30 is to make rotatable circular plate 80, and in turn, the adjusting disk 60 to stay in position after adjustment. The round surface 22 can be a complete surface or a surface with any shape and number of slots as necessary to reduce the weight or provide a lower profile of circular butterfly. A leaf 40 has a leaf surface 48 and an axle 46 with outboard end 42 inserted in radial hole 26 and inboard end 44 put in radial groove 34 so that it is rotatable during adjustment. The leaf surface 48 can be made of a flexible or non-flexible material. A flexible leaf surface could be more fun since the angle of attack of leaf 40 keeps changing during the flight motion. A rotatable adjusting disk 60 is installed at the center of circular butterfly 10. The adjusting disk 60 has a number of studs 64 on the top of center disk 62, a vertical circular rim 66 adjacent to center disk 62, another vertical rim 70 adjacent to an outboard ring surface 68, a corrugation 72 and an upper ring surface 74 which is used to confine inboard end 44 of leaf 40 to rotate within radial groove 34 without move away.

A circular plate 80 having tapered holes 84 is fitted on studs 64 of adjusting disk 60. All studs 64 are swelled then, to fix circular plate 80 on adjusting disk 60.

To adjust the angle of attack of leaf 40, rotate adjusting disk 60 so that corrugation 72 changes its relative elevation and in turn, rotates leaf surface 48, and in the same time, the single corrugation 86 of circular plate 80 changes to a new position on corrugation 30 of circular saucer 20, and stays there without move unless by a further adjustment.

In FIG. 4 a cross sectional view is shown which is taken along line II—II in FIG. 3. For the purpose of clarity, only important portions are shown. The corrugation 72 at outboard ring surface 68 is used to confine the angular position of leaves 40. A vertical rim 70 is perpendicular to outboard ring surface 68. The figure shows leaf surfaces 48 at one of their extreme positions with adjusting disk 60 at its extreme clockwise position as viewed from the top in FIG. 3 or at its extreme left position as seen in FIG. 4. The position of leaves 40 shown is for a person of left-handed. By moving adjusting disk 60 in FIG. 4 to the right, leaf surface 48 will turn in clockwise direction about the center of axle 46 and thus, reduce the angle of attack. When all leaves 40 are adjusted to the horizontal position, the angle of attack is zero.

FIG. 5 is a view similar to FIG. 4. By a further movement of adjusting disk 60 to the right or by a counter-clockwise rotation of adjusting disk 60 as viewed from the top of FIG. 3, leaf surfaces 48 of leaves 40 continue to rotate about the centers of axles 46 until the right side of leaf surfaces 48, as seen in FIG. 5, are below their horizontal positions. The figure shows leaf surfaces 48 at their other extreme positions with adjusting disk 60 at its extreme counter-clockwise position as viewed from the top in FIG. 3 or at its extreme right position as seen in FIG. 5. The position of leaves 40 shown is for a person of right-handed.

FIG. 6 shows how the adjusting disk 60 as well as circular plate 80 can stay in position during flight motion of circular butterfly 10. The thickness of disk 82 of circular plate 80 is larger than that of spring plate 88 on both sides of single corrugation 86. A corrugation 30 is shown adjacent to lower ring surface 32 of circular saucer 20. The inboard end 44 of axle 46 is installed in U-shaped radial groove 34. When circular plate 80 moves to either direction, the single corrugation 86 will slide upward to a peak and then, downward to a next valley and stay there. The spring plate 88 is used as flexible spring. To add the flexibility of single corrugation 86, each side may add a notch.

In FIG. 7, a cross sectional view similar to FIG. 4, but having a different adjusting means is shown. A spring 110 has one of its end 112 rest against leaf surface 148 of leaf 140, middle portion passing through axle 146 and leaf surface 148, and another end 114 inserting into a tapered hole 162 on adjusting disk 160. The position of leaf 140 is for a person of left-handed.

FIG. 8 shows a view similar to FIG. 7, having adjusting disk 160 in FIG. 7 moves to the left, that is, rotates in the clockwise direction as viewed from the top of a circular butterfly. The position of leaf 140 in this figure is for a person of right-handed.

In FIG. 9 a third preferred embodiment is shown. This embodiment is similar to the first one shown in FIG. 1. However, a number of slots are added, as visible from this top view, to provide spaces for leaves 240 to rotate upward. This circular butterfly 210 consists of a slotted circular saucer 220, a number of leaves 240, an adjusting disk 260 and a circular ring 280. Each leaf 240 has a leaf surface 248 and an axle 246 having outboard end 242 and inboard end 244. The number of leaves 240 can be of any required quantity. One of these types is seven leaves 240 with different colors which are the same as seven different original colors of sun light so that they become white during spinning in the flight motion. On circular saucer 220, there are a number of radial strips 222 adjacent to circular rim 218. On circular ring 280, there are a number of tapered holes 284. This circular ring 280 has a round hole at the middle. It can be a circular plate without a round hole at the middle. A small portion of adjusting disk 260 can be seen between gaps of leaves 240 and radial strips 222. On adjusting disk 260 there are a number of studs 264 fitted in the same position of tapered holes 284.

Figure 10:
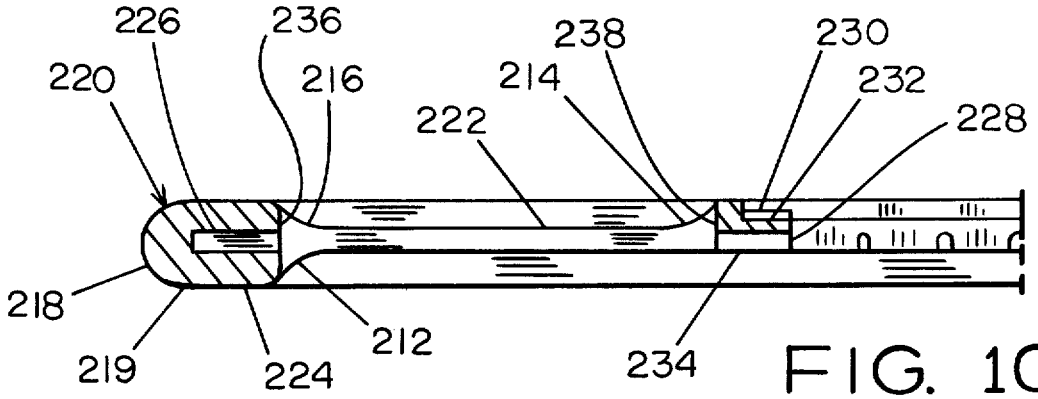
FIG. 10 is a cross sectional view taken along line IV—IV in FIG. 9, showing the slotted circular saucer only.

FIG. 10 shows a half cross sectional view taken along line IV—IV in FIG. 9. For the purpose of clarity, only circular saucer 220 is shown. There is a curved portion 219 adjacent to circular ring 224. A number of radial strips 222 adjoin the outboard portion and inboard portion with curved surfaces 212, 214 and 216. A number of radial holes 226 and U-shaped radial grooves 234 are provided to install leaves 240. Two vertical rims 228 and 238 are located at the inboard portion. On lower ring surface 232 there is a partial corrugation 230 which is the same as that shown in FIG. 6.

Figure 11:
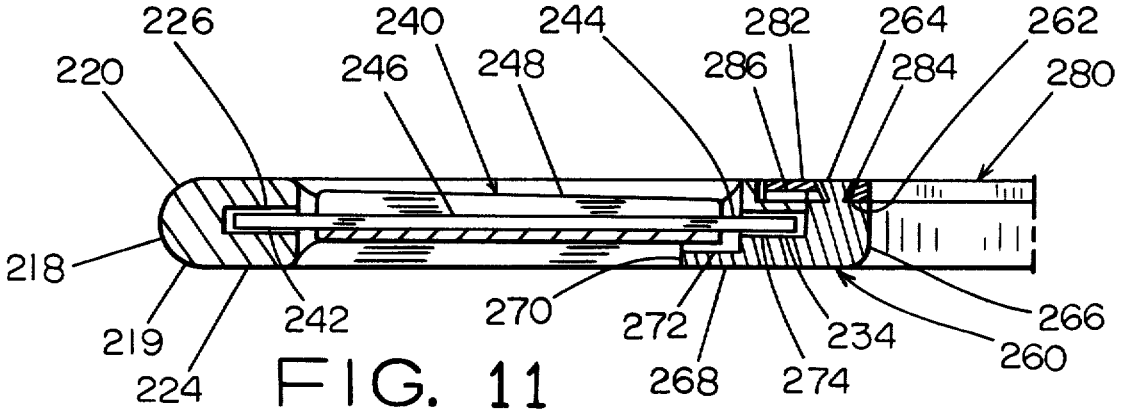
FIG. 11 is a cross sectional view taken along line V—V in FIG. 9, showing a complete view.

FIG. 11 shows a complete half cross sectional view taken along line V—V in FIG. 9. Actually, line V—V coincides with line IV—IV. The circular saucer is the same as described previously. As can be seen, leaf 240 consists of a leaf surface 248 and an axle 246 having an outboard end 242 inserted in radial hole 226 and another inboard end 244 put in U-shaped radial groove 234. An adjusting disk 260 consists of two vertical rims 266 and 270, two ring surfaces 262 and 268, a number of studs 264, an upper ring surface 274 to confine the rotation of inboard end 244 of leaf 240, and a corrugation 272 which is the same as shown in FIG. 6. The adjusting disk 260 may be made without a hole at the middle. A circular ring 280 has a ring surface 282, a number of tapered holes 284, a single corrugation 286 with thiner layers on both sides, which is the same as shown in FIG. 6. The studs 264 will be swelled after assembly. The adjusting procedures are the same as previously described for the first preferred embodiment.

Figure 12:
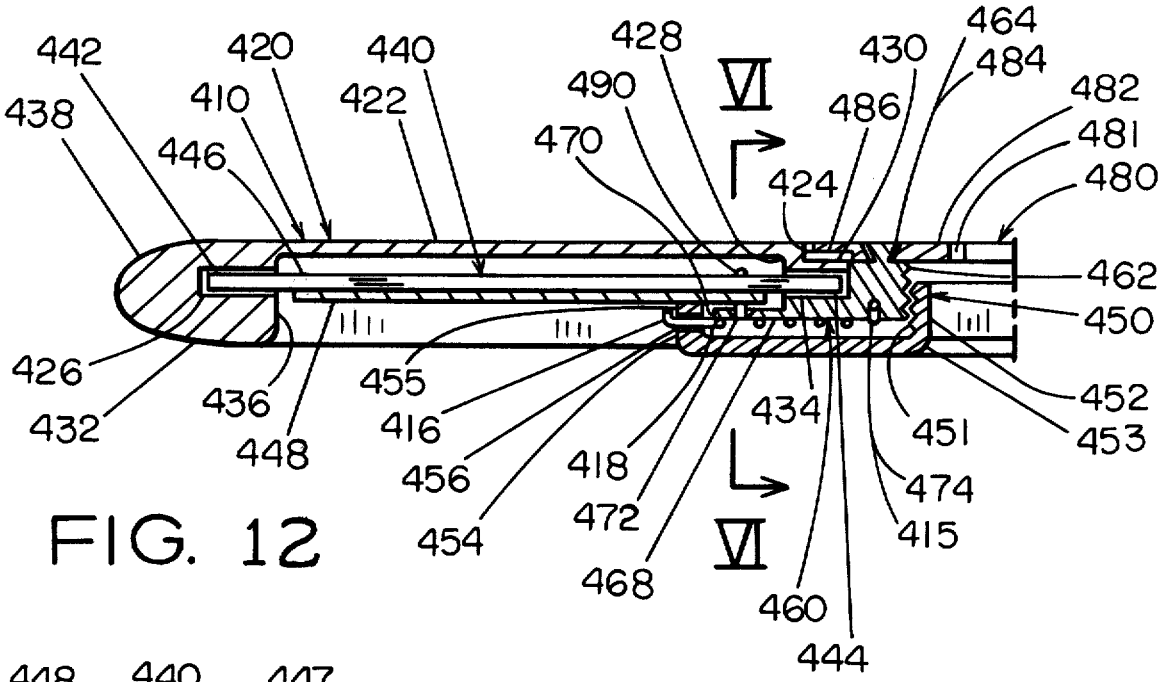
FIG. 12 is a cross sectional view of the fourth preferred embodiment having another self-rotatable device to change the angle of attack of leaves during the flight motion.

In FIG. 12, there is a cross sectional view of a fourth preferred embodiment of circular butterfly 410 which consists of a circular saucer 420, a number of leaves 440, a temporal adjusting disk 450, a disk 460, a number of springs 490, a spring 418 and an adjusting ring 480.

The circular saucer 420 is similar to that described in the first preferred embodiment, which has a round surface 422, a circular rim 424, a number of radial holes 426, two vertical circular rims 428 and 436, a ring surface 432 adjacent to a circular rim 438, a partial corrugation 430 and a number of U-shaped radial grooves 434. The leaf 440 has a leaf surface 448 and an axle 446 with an outboard end 442 inserted in radial hole 426 and an inboard end 444 put in radial groove 434. The disk 460 has a number of studs 464, a female threaded rim 462, another rim 470 and a ring surface 468 having a vertical hole 474 and a number of tapered holes 472. The spring 490 has one of its ends wired on leaf 440 and the other end inserted into tapered hole 472. The functions and arrangements of leaf 440, spring 490 and disk 460 are exactly the same as those shown in FIG. 7. The adjusting ring 480 has a number of tapered holes 484 on ring surface 482, a single corrugation 486 and a corrugation 481 at the middle which is provided to facilitate adjustment by the fingers of a person.

The temporal adjusting disk 450 consists of a vertical circular rim 452, a male threaded rim 451, a ring surface 453, another vertical circular rim 454 having a horizontal hole 456, and a corrugation 455. The coil spring 418 has one of its ends 415 installed in vertical hole 474 and the other end 416 installed in horizontal hole 456.

To adjust the angle of attack of leaves 440, rotate adjusting ring 480 as well as disk 460 so that springs 490 as well as leaves 440 will be rotated. This angle, say five degrees, is the angle of leaves at the end of the flight motion. At the beginning of the flight motion, it is better to have a zero angle of attack so that the drag force is a minimum one. To accomplish this purpose, rotate temporal adjusting disk 450 to raise itself along the female thread to the highest position so that the corrugation 455 urges leaf surfaces 448 of leaves 440 to horizontal position temporarily with spring 418 winded. Upon release of temporal adjusting disk 450, the spring 418 will unwind gradually. The corrugation 455 is used to retard the unwinding speed. The circular butterfly will be thrown into the air as soon as the temporal adjusting disk 450 is released, so that at the beginning the angle of attack of leaf surfaces 448 is approximately zero, and during the flight motion the angle will increase gradually, until at the end of the flight, the angle will return to the original setting position; that is, five degrees. By this adjustment of the temporal adjusting disk 450, it is easier for the player to catch the circular butterfly 410.

Figure 13:
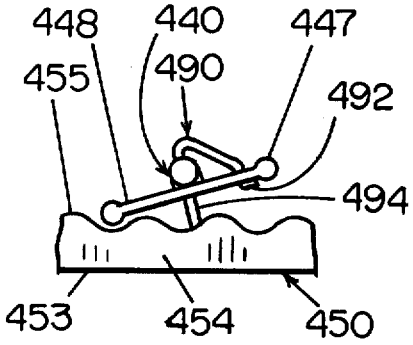
FIG. 13 is a cross sectional view taken along line VII—VII in FIG. 12, showing the position of a leaf at the end of flight motion with the circular butterfly spinning in the counter-clockwise direction as viewed from the top.

In FIG. 13, there is a cross sectional view taken along line VII—VII in FIG. 12. Only important portions are shown for the purpose of clarity. On the temporal adjusting disk 450, there are a ring surface 453, a vertical circular rim 454 and a corrugation 455. A spring 490 has one of its ends 492 attached to the leaf surface 448 in this figure and the other end 494 inserted in tapered hole 472 in FIG. 12. On the leaf surface 448 of leaf 440 there is a ball end 447 on each side. The function of ball ends 447 and corrugation 455 is to retard the unwinding speed. The angle of leaf 440 shown is set for a person of left-handed. It is also the position at the end of the flight motion.

Figure 14:
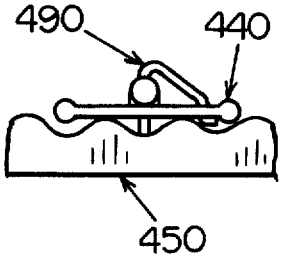
FIG. 14 is a view similar to FIG. 13, showing the position of a leaf at the beginning of flight motion.

FIG. 14 shows a view similar to FIG. 13. The position of leaf 440 is adjusted temporarily for a person of left-handed or right-handed at the beginning of the flight motion.

Figure 15:
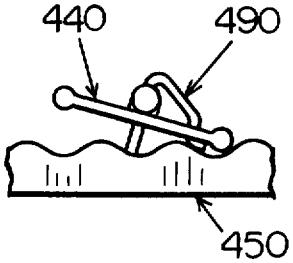
FIG. 15 is a view similar to FIG. 13, showing the position of a leaf at the end of flight motion with the circular butterfly spinning in the clockwise direction as viewed from the top.

FIG. 15 shows a view similar to FIG. 17. The position of leaf 440 shown is set for a person of right-handed. It is also the position of leaf 440 at the end of the flight motion of circular butterfly 410.

In FIG. 16 there is a cross sectional view of the fifth preferred embodiment which is similar to the third preferred embodiment. The circular butterfly 510 consists of a circular saucer 520, a number of leaves 540, an adjusting disk 560 and a circular plate 580. The circular saucer 520 has an outboard ring 524 with circular rim 518 and a number of radial holes 526, an inboard ring 536 with a partial corrugation 530 and a number of U-shaped radial grooves 534, and a number of radial strips, which are visible in the next figure, joining outboard ring 524 and inboard ring 536 by curved portions 512, 514 and 516.

The leaf 540 has a leaf surface 552, an outboard end 542 inserted into radial hole 526 and an inboard end 544 put in U-shaped radial groove 534. At the extreme end of inboard end 544 there is a tapered rod end 548. The adjusting disk 560 has a center disk 562 with a number of studs 564, a ring surface 568 adjacent to curved portions 566 and 570, an upper ring surface 574 to confine the rotation of inboard end 544 of leaf 540, a circular groove 576 and a tapered corrugation ring 572.

The circular plate 580 has a disk 582 with a number of tapered holes 584, a single corrugation 586 with an U-shaped thin layer 588 surrounded so that the single corrugation 586 can be used as a spring, and a tapered corrugation ring 590 which combined with the lower tapered corrugation ring 572 becomes a tapered circular corrugation groove to guide the tapered rod ends 548 to move mainly upward and downward.

In FIG. 17 a portion of the bottom view of FIG. 20 is shown. Only main portions are shown for the purpose of clarity. Again, an outboard ring 524 and an inboard ring 536 are joined by a number of radial strips 522. There are tapered slots 528 between inboard ring 536 and outboard ring 524, and U-shaped radial grooves 534 at inboard ring 536. A leaf 540 shown has a leaf surface 552 of the same shape as a tapered slot, an outboard end 542, an inboard end 544 rotatable within U-shaped groove 534, an elbow 546, a tapered rod end 548 and a leaf end 550 which is used as a small spring pressing against circular rim 538 so that tapered rod end 548 engages completely into tapered circular corrugation groove formed by corrugation ring 572 and corrugation ring 590.

FIG. 18 is a view similar to FIG. 6. On circular saucer there is a partial corrugation 530 which confines the angular position of single corrugation 586 surrounded by U-shaped thin layer 588 on circular plate 580. A number of inboard ends 544 are confined by U-shaped grooves 534 and upper surface 574 of adjusting disk 560. By the rotating of the ring surface 568, the angle of attack of leaves 540 will be changed as described previously.

FIG. 19 shows a corrugation groove formed by corrugation rings 572 of adjusting disk 560 and 590 of circular plate 580. The cross sections of rod ends 548 move mainly upward and downward to rotate leaves 540 to change their angle of attack, when adjusting disk 560 as well as circular plate 580 are rotated.

The descriptions and illustrations mentioned above are those of the most preferred embodiments of this invention and no unnecessary limitations should be understood therefrom as modification will be obvious to those skilled in the art.

I claim:

1. A throwing implement comprising, a circular saucer having a round surface, a circular rim about the outer periphery of said round surface, a lower ring surface about the inner periphery of said round surface, said lower ring surface having corrugations over at least a portion of its upper face, said lower ring surface defining a round hole in the middle of said throwing implement, a plurality of radial holes in said circular rim, and a plurality of downwardly facing U-shaped radial grooves in the lower face of said lower ring surface;

a plurality of leaves, each leaf having a leaf surface secured to an axle intermediate the ends of said axle, an outer end of each axle being mounted in one of said radial holes and an inner end of each axle being mounted in a corresponding one of said U-shaped radial grooves;

means for retaining the inner ends of said axles in said U-shaped radial grooves; and adjusting means for changing the angle of attack of said leaves with respect to the plane of said round surface.

2. A throwing implement according to claim 1, wherein said adjusting means comprises;

an adjusting disc rotatably mounted within said round hole, having an outboard ring surface, said outboard ring surface having corrugations on its upper face and underlying the inner ends of said leaves and a center disc with a number of studs and an upper ring surface underlying said lower ring surface; and a circular plate rotatably mounted within said round hole, having a portion overlying said lower ring surface, said portion having a single corrugation on its lower face engaging said corrugations on the upper face of said lower ring surface, and said studs on said center disc engaging said circular plate and securing the former to the latter.

3. A throwing implement according to claim 2, wherein each of said center disc of said adjusting disc and circular plate has a hole at the middle.

4. A throwing implement according to claim 1, wherein said round surface of said circular saucer has a plurality of corresponding slots having the same shape as said leaves.

5. A throwing implement according to claim 1, wherein the number of said leaves is a multiple of seven, having seven different colors which are the same as the seven original colors of sun light.

6. A throwing implement according to claim 1, wherein said adjusting means comprises;

an adjusting disc rotatably mounted within said round hole, having an outboard ring surface, said outboard ring surface having a plurality of holes and underlying the inner ends of said leaves and a center disc with a number of studs and an upper ring surface underlying said lower ring surface;

a plurality of springs, each spring having one of its ends attached to said leaf and the other end inserted into said hole of said outboard ring surface; and a circular plate rotatably mounted within said round hole, having a portion overlying said lower ring surface, said portion having a single corrugation of its lower face engaging said corrugations on the upper face of said lower ring surface, said studs on said center disc engaging said circular plate and securing the former to the latter.

7. A throwing implement according to claim 1, wherein said leaves, each leaf has a leaf surface securred to an axle intermediate the ends of said axle, an outer end of each axle being mounted in one of said radial holes and an inner end of each axle being mounted in a corresponding one of said U-shaped radial grooves; said inner end having an elbow perpendicular to said axle, a tapered rod end in radial direction and a leaf end pressing against the vertical ring surface about said inner periphery of said round surface; and wherein said adjusting means comprises;

an adjusting disc rotatably mounted within said round hole, having an outboard ring surface underlying the inner ends of said leaves, a center disc with a number of studs, a circular groove with opening facing upward, a tapered corrugation in a vertical circular rim and a number of studs and an upper ring surface underlying said lower ring surface; and a circular plate rotatably mounted within said round hole, having a portion overlying said lower ring surface, said portion having a single corrugation on its lower face engaging said corrugations on the upper face of said lower ring surface, a tapered corrugation in a vertical circular rim overlying said tapered corrugation of said adjusting disc, both said tapered corrugations of said circular plate and said adjusting disc forming a corrugation groove to guide said tapered rod ends of said leaves, said studs on said center disc engaging said circular plate and securing the former to the latter.

8. A throwing implement according to claim 1, wherein there is a temporal adjusting means in addition to said adjusting means, said temporal adjusting means being used to change the angle of attack of said leaves during the flight motion.

9. A throwing implement according to claim 8, wherein said adjusting means comprises;

a disc rotatably mounted within said round hole, having an outboard ring surface, said outboard ring surface having a plurality of holes and corrugations on its upper face and underlying the inner ends of said leaves and a center ring with a number of studs, an upper ring surface underlying said lower ring surface, a single hole at the bottom of said center ring and a female threaded rim about the inner periphery of said center ring;

a plurality of springs, each spring having one of its ends attached to said leaf and the other end inserted into said hole of said outboard ring surface of said disc; and an adjusting ring rotatably mounted within said round hole, having a portion overlying said lower ring surface, said portion having a single corrugation on its lower face engaging said corrugations on the upper face of said lower ring surface, said studs on said center ring of said disc engaging said adjusting ring and securing the former to the latter, and a plurality of corrugations at the middle about the inner periphery of said adjusting ring; and wherein said temporal adjusting means comprises;

a temporal adjusting disc rotatably mounted within said round hole, having a ring surface, an outer and an inner vertical circular rims perpendicular to said ring surface, said outer vertical circular rim having a horizontal hole, said inner vertical circular rim having a male thread to match said female threaded rim of said disc in said adjusting means, and a plurality of corrugations at the upper face of said outer vertical circular rim; and a spring having one of its ends inserted into said single hole on said center ring of said disc, and the other end inserted into said horizontal hole on said outer vertical circular rim of said temporal adjusting disc.

10. A throwing implement according to claim 8, wherein said round surface of said circular saucer has a plurality of corresponding slots having the same shape as said leaves.

11. A throwing implement according to claim 8, wherein the number of said leaves is a multiple of seven, having seven different colors which are the same as the seven original colors of sun light.

* * * * *